United States Patent [19]

Fry et al.

[11] 3,977,980

[45] Aug. 31, 1976

[54] SOLID FABRIC CONDITIONER COMPOSITION

[75] Inventors: Franklin Hornor Fry, Huntington Beach, Calif.; Orville Reinke, Oshkosh, Wis.; Wayne A. Marthaler, Ridgefield, Conn.; Richard K. Wylie; Frederick C. Boye, both of Appleton, Wis.

[73] Assignee: American Can Company, Greenwich, Conn.

[22] Filed: Jan. 4, 1974

[21] Appl. No.: 430,651

[52] U.S. Cl. ..... 252/8.8; 427/242

[51] Int. Cl.[2] ..... D06M 13/36

[58] Field of Search ..... 252/8.8, 547, 155, 174, 252/182

[56] References Cited

UNITED STATES PATENTS 3,549,545 12/1970 Stolmeijer ..... 252/152

OTHER PUBLICATIONS

Chem. Abst. No. 10 vol. 81 9/9/74 p. 65146w.

*Primary Examiner*—Murray Tillman
*Assistant Examiner*—T. Pertilla
*Attorney, Agent, or Firm*—Robert P. Auber; Ernestine C. Bartlett; George P. Ziehmer

[57] ABSTRACT

A solid fabric conditioner composition comprising a mixture of a conditioning agent and diatomaceous earth in compressed form is employed to condition fabrics in an automatic clothes dryer. Methods for utilizing such products wherein the rate of release of conditioner to fabrics being treated is predetermined and controlled are also provided.

8 Claims, No Drawings

SOLID FABRIC CONDITIONER COMPOSITION

BACKGROUND OF THE INVENTION

In laundering, it is common to treat various types of fabrics with chemical compounds which have long been known to possess the qualities of imparting softness, antistatic properties, bacteriostatic properties, moth-proofing and other conditioning treatment to render them soft to the touch, bacteria resistant, deodorized, etc. In both commercial and home launderies, it is currently the practice to treat such fabrics with an adjuvant in the washer, usually during the final deep rinse cycle after it has been washed.

As a result of prior laundering, residual soaps and detergents are present on the fabric. Some fabric conditioning agents are cationic, are incompatible with the anionic occuluded soaps and detergents and suffer loss of effectiveness by mutual precipitation in contact with the residual soap or detergent even when the conditioning agents are added in the final rinse. Although some of said conditioners are expressly marketed for use during the wash cycle, such compounds are usually merely more concentrated forms of the rinse cycle additives and share the common disadvantage of loss of effectiveness due to reaction with residual soaps and detergents. Additionally, most of such conditioners now commercially available were devised at a time when cotton was the more common fabric being treated. More recently however, the fabric mix of the average wash load has changed with more than one-half being composed of synthetic fibres which present different problems and necessitate different considerations for conditioning. For example, synthetic fibres tend to take up less of cationic softeners which are ionized in the wash or rinse water than do cotton fibres because they have fewer negative charges to attract the positive, cationic softening ingredient. Another consideration related to the successful use of such conditioning products is convenience of use. A major disadvantage of washer additives has been the fact that the user often must stay in the laundry area or return to the laundry area to add the adjuvant at the proper time and often fails to do so thereby resulting in repeated rinse cycles until the adjuvant is timely added or more often, failure to add conditioner completely. Additionally, such compositions are not generally pre-measured with the result that the user often either uses an amount insufficient to adequately condition the fabric or wastes the product by using excessive amounts.

More recently, various and ever increasing proposals for effecting such fabric conditioning in the dryer have been proposed as a viable alternative to those above enumerated. Such proposals have taken the form of sprays, flexible substrates bearing the conditioning agents, solid plastic balls containing such agents or substrates containing adjuvant affixed to the wall of the dryer. None of these proposals have been without serious disadvantages however. For example, the use of sprays of fabric softeners or other applications of such liquids to the laundry in the dryer usually involves the same problems of applications of insufficient or excessive amounts of material. Additionally, with such sprayed additives, it is difficult to treat multiple loads of fabrics consecutively, e.g., after the first load is completed, since the hot dryer tends to vaporize the additive initially venting out major proportions of the adjuvant. Moreover, it has been found that humidity sensors or other devices functioning as automatic shut-off mechanisms as well as the heating elements of the dryer, tend to become coated with such sprays after repeated use rendering such components of the dryer inoperable. Corrosion of the dryer drum is often another detrimental effect encountered with prolonged use of such aerosol spray products. Staining, spotting or other detrimental effects due to local applications of excess conditioning agent are often observed. If a flexible sheet such as paper or cloth is impregnated with conditioning agents and the product is tumbled with laundry, staining is often observed due to temporary entrapment of the flexible article in the laundry being treated which causes the application of more conditioning agent than is desirable at particular locations on the treated fabrics. Such local over applications may also be caused by cracking or flaking off of the conditioning agent when the flexible substrate is folded, creased, twisted, bent, etc. during tumbling with the laundry. Additionally, such sheets may obstruct the dryer vent causing high heat buildup in the dryer. And finally, even if none of these detriments occur, such sheets must be removed from the clothes being treated adding another step to the laundry process.

In the past, it has been suggested that an improved method of applying conditioning agent to fibrous materials in the dryer would involve the use of form-retaining bases for such material so that the base would not bend, fold, crease or flex sufficiently to cause the conditioning agent to flake off. Thus solids such as polystyrene balls have been taught to be useful when coated with fabric conditioner. Such articles tumble with the laundry and although they are not difficult to locate after use, must be found and separated from the laundry after completion of the treatment cycle again adding an additional step to an already tedious operation.

It is an object of this invention to provide a fabric conditioning composition which contains premeasured amounts of conditioning agents and thereby eliminates problems derived from insufficient or excessive application of the same.

It is another object of this invention to provide a fabric conditioner which is suitable for use in the dryer while conveying softness after use that is at least comparable to that obtained in the washer.

Still another object is to provide a fabric conditioner which may be used without spotting and staining of the fabrics being treated under the normal conditions met in the automatic dryer.

A further object of the invention is to provide a fabric conditioner composition suitable for use in the dryer which need not be located and separated from the items treated at the completion of the treatment.

Another object is to provide a method for conditioning fabrics as well as a method for controlling the release of conditioning agents to the fabrics while in the dryer.

Another object is to provide a fabric conditioner composition which imparts softness to the surface of the fabrics while preserving absorbancy of the internal weave.

DETAILED DESCRIPTION OF THE INVENTION

These and other objects are achieved by this invention which provides a fabric conditioner composition consisting essentially of a fabric conditioning adjuvant in admixture with diatomaceous earth in solid and compressed form. Such products are produced by a method which comprises mixing the components of the composition at a sufficient rate and subjecting said mixture to sufficient pressure to obtain a product of sufficient hardness to disintegrate and release the adjuvant to the fabrics within a predetermined period of time.

Conditioning of the fabrics according to the process of the invention is effected by the disintegration of the product as a result of the tumbling action in the dryer to release the conditioner to the fabric surface in a current of air or other inert gas. The solid conditioning agent released during disintegration is deposited on the surface of the materials being treated while the diatomaceous earth, which also functions to prevent staining or spotting, substantially disappears during the cycle, e.g., the major proportion disintegrates and is applied to the fabric along with the conditioner while a minor proportion may be either vented or intimately associated with the lint.

According to the method of the invention, the mixture of conditioner and diatomaceous earth is compacted to sufficient hardness to exhibit a compressive strength within the range of about 8 to about 26 pounds per square inch, hereafter designated psi. Such a product disintegrates at a rate sufficient to release conditioner to the fabrics in a period not less than about 5 minutes but not more than about 20 minutes after starting the dryer.

Extremely good results are obtained according to the invention when a product is utilized having sufficient compressive strength to exhibit a rate of disintegration whereby the product begins to break up in a substantial proportion after 5 minutes in the dryer with substantially complete disintegration occurring within 20 minutes. Such a rate of disintegration is believed to be critical to the successful operation of this invention. The products must be of sufficient compresive strength to resist substantial disintegration before 5 minutes have elapsed in the drying time since such a rapid rate of disintegration will result in loss of product and relatively little conditioning of the fabrics. Conversely, the compressive strength of the product must not be so great that substantial disintegration does not occur within 20 minutes since after this time, the solid product tends to melt in a solid mass resulting in spotting and staining of the fabrics. That the fabric conditioner compositions of this invention in addition to exhibiting a rate of disintegration as specified hereinabove also are substantially completely applied to the fabrics being treated is evidenced by the very small amount of product remaining in the lint trap of the dryer after such treatment has been completed. This is illustrated hereinbelow with a concomitant and high degree of softness obtained.

The fabric conditioner products herein are produced by a process which comprises mixing the solid conditioning agent with diatomaceous earth in a suitable mixer such as a Ribbon blender, etc. at a sufficient rate and subjecting the mixture to sufficient pressure to obtain a product exhibiting the characteristics described hereinabove.

In practive, an apparatus comprising two cylindrical wheels or rolls, positioned one above the other with their axes of rotation being horizontal and parallel, is employed to produce the products of this invention. The axle of the lower cylinder is fixed and stationary while the axle of the upper wheel is pivoted at some distance to the right of the wheel thereby permitting upward movement of the upper wheel and axle from the horizontal a few degrees. Pressure on the upper axle is supplied by suitable means, for example, by hydraulic piston to permit control of the compression obtained by the pressure exerted and the degree of compaction of the product produced. The desired shape of the product may be designed in the wheels. Preferably, such shapes are such as to provide a briquet form and such apparatus is a briquetting machine. The material to be compressed is fed to the wheels by a feed screw whose axes of rotation is horizontal but perpendicular to the rotational axes of the briquetting wheels. In operation, the bulk raw materials feed along the screw into the depressions in the wheels where such materials are compacted and removed therefrom by suitable means. The independent variables in the apparatus are the speed of rotation of the counter-rotating rolls or wheels, the pressure on the upper wheel axle and the speed of the feed screw. In general, suitable limits for each have been determined to be about 1 to 400 rpm, 0 to 4000 psi and 1 to 400 fpm, respectively. These variables as exerted by the apparatus have been found to be adequate to produce products having compressive strengths within the range of about 8 to about 26 psi.

The term "compressive strength" as employed herein is meant to indicate the measure of the product resistance to a crushing force and is expressed in pounds per square inch, e.g., psi, the value being the force in which a fracture or rupturre occurs as determined by American Can Company Standard Test Method M-621, May, 1973. In such method, compressive strength is measured along a vertical axis of the product, that is, along an axis perpindicular to the briquet at rest on a flat surface. Briefly, such test method employs an Instron tensile tester, Instron Corporation, Canton, Mass., equipped with a (0–50 lb. or 0–50Kg) compression load cell and appropriate platens. At least ten product specimen are selected at random from each sample lot to be tested. Each product specimen is placed on the lower platen and the minimum, maximum, and average force value necessary to rupture or fracture the specimen is recorded.

Classes of adjuvants or conditioners which may be employed in the present invention include fabric softeners, soil repellents, soil release agents, hand modifiers, wrinkle removers, antistatic agents, mothproofing agents, water repellent agents, optical brighteners, germicides and sanitizing agents, etc. Any one or mixtures of such adjuvants included in the above classes may be utilized herein, it being important to the present invention only that the ingredient be compactible with diatomaceous earth to a compressive strength of about 8 to about 26 psi and once compacted, exhibit a break up rate under the conditions met in the standard automatic dryer reached within 5 to 20 minutes. Dryer temperatures start in general at room temperature (about 75°F) and reach up to about 200°F or higher depending on the load of fabrics and the type of fabrics making up the load usually with little variation from this range regardless of the dryer temperature setting selected.

It is an unexpected feature of the present product that its application is not dependent on the presence of heat but rather on the forces exerted in the dryer. As illustrated further hereinbelow, satisfactory breakup and conditioning of the fabrics have been obtained with the instant products in the presence or absence of heat. Such a characteristic conveys a wide degree of versatility and convenience in terms of the type of conditioning that may be applied, the types of fabrics that may be treated, etc.

More specifically, such compounds may include:

A. Cationic quaternary ammonium salts

B. Non ionic compounds including tertiary amine oxides and phosphine oxides

C. Zwitterionic quaternary ammonium compounds

D. Ampholytic tertiary ammonium compounds

E. Compatible mixtures of one or more compounds of these classes. Such classes are usually indicative of and utilized as/or with:

1. Fabric softeners such as quaternary ammonium compounds, etc.

2. Optical brightners such as disulfonated diaminostilbene compounds, etc.

3. Essential oils and fragrances.

4. Antistatic agents such as quaternary ammonium compounds in combination with ethanolamides such as tallow ethanolamides, etc.

5 Germicides such as the halogenated salicylanilides, benzalkonium quaternary compounds, etc.

6. Bodying agents such as starch, etc.

7. Soil release agents such as polyacrylic-polyvinyl alcohol compositions, etc.

Particularly preferred herein are fabric softening agents comprising cationic quaternary ammonium salts of the general formula:

$$[R\ R_1\ R_2\ R_3\ N]^+X^-$$

wherin X is an anion, preferably a halide such as chloride or acetate, sulfate, phosphate, methyl sulfate, etc.; R and $R_1$ are alkyl or aralkyl, $R_2$ is alkyl, aralkyl, alkoxy, etc.; and $R_3$ is an alkyl group containing 12 to 20 carbon atoms. The most preferred compounds are dialkyl dimethyl ammonium chloride or alkyl methyl ammonium chloride wherein the alkyl contains from 12 to 20 carbon atoms and is derived from long chain fatty acids, especially from hydrogenated tallow, the term "tallow" meaning alkyl radicals containing 15 to 18 carbon atoms. Combinations of such compounds with other compounds which lower their softening points such as ethyl alcohol, isopropyl alcohol, water/isopropanol mixtures, etc., are also contemplated.

Many of the preferred compounds are available commercially and are designated by their tradenames herein. The tradenamed fabric softeners employed in the examples herein or their equivalents are highly effective. Thus, "Arosurf TA-100", "ADOGEN 442" and "ARQUAD 2HT-75" all contain as the active ingredient the cationic fabric softener, ditallowdimethylammonium chloride which is especially preferred herein.

Other suitable softening compositions are well known in the art and include additional cationic compounds not specifically listed above such as distearyl dimethylammonium chloride, dilauryl dimethylquaternary ammonium chloride; tallowtrimethylammonium chloride; tallowdimethyl (3-tallow alkoxypropyl)ammonium chloride; ditallowdimethylammonium sulfate; eicosyltrimethyl ammonium chloride; dieicosyldimethylammonium chloride; ditallowdimethylammonium phosphate; didodecyldiethylammonium acetate; dodecyltrimethylammonium methylsulfate; tetradecyltrimethyl ammonium chloride; Zwitterionic quaternary ammonium compounds such as 3-N-eicosyl-N,N-(dimethylammonio)-2-hydroxypropane-1-sulfonate; 3-[N-eicosyl-N,N-di(2-hydroxyethyl)-ammonio]-2-hydroxypropane-1-sulfonate; 3-(N-hexacosyl-N,N-dimethylammonio)-propane-1-sulfonate; Nonionic tertiary phosphine oxides and tertiary amine oxide compounds such as eicosyldimethylphosphine oxide; tetracosyldi(2-hydorxyethyl)-phosphine oxide; stearyl dimethyl amineoxide, eicosyl-bis-(2-hydroxyethyl)amine oxide; eicosyldimethylamine oxide, etc.

The second essential component of the present conditioning product is diatomaceous earth in either natural or calcined form. This material is characterised by its very high surface area in proportion to its weight and appears to be vital and essential to the successful operation of the invention. It is believed that the inert diatomaceous earth employed herein serves several functions. It is believed that it serves to physically block or limit the contact between the particles of dthe conditioning agent and thereby permits weakening and break-up of the product, hereafter referred to as the briquet, under the weak physical forces exerted in the dryer. The softener or other conditioner, through the function of the diatomaceous earth, is exposed to the weak physical forces obtained in the average home dryer which gradually reduce the product to small particles. The particles are applied and are slowly distributed, through possibly a rubbing action to the nap of the fabric allowing just enough softener to be applied thereto. The excess softener is absorbed into the diatomaceous earth itself and/or lint, is broken off and deposited into the dryer lint trap under the combined effect of dthe dryer temperature, if heat is used, and tumbling action eliminating the staining which results when excess softener melts on the fabrics. This procedure has the best results when Dicalite 395 having a micron size of about 4 to 10 is employed as the releasing agent. This is thus the preferred form of diatomaceous earth. The preferred softener is Arosurf TA-100, identified further hereinbelow, of a partricle size whereby about 2 to 5% is retained on a 20 mesh screen. Additionally, the unique characteristics of the diatomaceous earth are believed to convey the ability to produce a product of just the right compressive strength which permits break-up in the dryer at the desired rate within the desired period of time. This belief is reinforced by unsuccessful attempts to control the break-up rate employing absorbents or solid carriers other than diatomaceouos earth reported further hereinbelow.

Diatomaceous earth including those commercially available as "Dicalite", Grefco Inc., Torrance, California, and Eagle Pitcher MT-78; F-85, etc. Eagle Pitcher Co., Des Plaines, Illinois and also including diatomaceous earth of the natural, calcined and flux calcined types may be employed herein. The most preferred products range in density from about 1.95 to 2.05 and vary in particle sizes of about 40 to less than 3 microns.

Compositions comprising various amounts of conditioning agent relative to diatomaceous earth are employed herein. In general, such amounts will vary from about 30 to about 55% by weight of diatomaceous earth to about 70 to about 45% by weight conditioning agent. Amounts substantially below or above either of the limits of these ranges are to be avoided since they result either in products which are too hard to disintegrate as prescribed herein or which disintegrate too rapidly with the detrimental results described hereinabove.

In general, the solid products of the invention will contain from about 1g. to about 10g. of conditioning agent and diatomaceous earth in a single briquet, preferably from about 3 to 7 grams. Shape and dimensions of the product may vary as desired. For example, the briquet may be substantially flat, elliptical, obround, round, etc. The products exhibit a high surface area in proportion to weight which, it is believed, is attributable to properties of the diatomaceous earth, said high surface area conveying many of the improved properties derived herein.

The following standards for evaluating the properties of the products produced according to the invention are set forth for ease of discussion in the working examples: Softness, Rate of Absorbancy, Distribution, Staining and Break-up Rate.

Softness

For evaluating softness conveyed by a product, mixed clothing are mixed with a number of towels, usually six, to make up an 8 to 10 lb. dry weight of laundry and washed with a nonionic detergent. The thus treated clothing is admixed in a dryer with a softener product of this invention for evaluation. For comparison, wash or rinse cycle commercial softener products are also applied to such a mix of clothing at the appropriate point in the washing or rinsing cycle using the maximum amount rcommended by the manufacturer, usually two capfuls. Dryer softeners other than those of this invention are likewise applied as directed unless otherwise specified. After the clothes have been softened and dried, the towels contained therein are stored under controlled conditions of temperature and humidity (72°F, 52% relative humidity) for 24 hrs. Since the moisture in a towel has a direct effect on its relative softness, it is necessary to evaluate softness at the same relative humidity. After the towels have been thus treated, they are evaluatd qualitatively by panels of six people. The procedure for rating the softness of the towels is designed to select the softer of several pairs of towels treated in a variety of ways usually including towels softened by the leading commercial rinse cycle additive as a reference point. The panelists were shown all possible pairs of towels in a blind comparison, i.e., without knowledge of which product was used on the particular towels, asked to select the softer pairs of samples and the results were tabulated. The sum of total points per additive per panel was used to rank the additive. Such a method is derived from J. J. Maroney, *Facts with Figures*, Penquin Books, Baltimore, Maryland (1951), pp. 340 to 353.

Absorbancy

The rate of absorbancy is determined utilizing swatches of terrycloth which has been laundered and softened a predetermined number of times. The swatches are cut into strips 3.5 inches by 1 inch, the end of each swatch is then immersed in a permanent ink solution and the time required for the ink to climb a fixed distance up the toweling strip is recorded. Ten trials were run for each softener employed and the results averaged. The absorbancy was determined for both warp and woof directions. Such a method is derived from the Technical Association of Pulp & Paper Institute (TAPP I) Method RC-8.

Distribution

Distribution is evaluated on laundered and softened fabrics, usually terrycloth, which are treated with a dye which reacts only with the softener and not the fabric. Visual inspeciton reveals distribution of the softener on the cloth. The method employed herein uses a 0.01% solution of Bromophenol Blue having a ph of 8.0. Samples of treated towels are rinsed thoroughly with cold tap water and the swatch immersed in the solution for three minutes after which it is removed and rinsed thoroughly with tap water. The sample is then air dried and observed for distribution or uniformity of blue color.

Staining

Staining or spotting is evaluated employing both swatches and whole pieces of wet fabrics. The treated fabrics were visually evaluated for stains and the following data was recorded: a) the size of the spots measured in inches, (*b*) the number of the spots occuring, (*c*) the square inch area of the spots or stains (*d*) the total fabric area treated.

Disintegration

Break-up or disintegration of the product was determined by first recording the weight of the product and then adding the same to a dryer containing fabrics. Products of the invention and others for comparison were utilized all of which were made at a briquetter pressure roll speed and screw speed as indicated. The products were tumbled in a dryer for the period of time indicated after which the residue left in the lint trap and/or dryer was weighed to determine the extent of disintegration of the product. The fabrics were also visually inspected for presence of softener product and staining.

The following examples will serve to illustrate the invention.

EXAMPLE 1

Softener products were prepared employing a Komarek Model 100-B "2-roll" Briquetter, (Komarek, Inc., Elkgrove Village, Ill.) employing the following formulations:

| | | |
|---|---|---|
| (Comparative) | A. | 100% Arosurf TA-100, a commercially available ditallowdimethyl ammmonium chloride softener (Ashland Chemicals Co., Columbus, Ohio) |
| | B. | 60% TA-100, 40% Dicalite 395, diatomaceous earth, (Grefco, Inc., Torrance, California) |
| (Comparative) | C. | 80% TA-100, 20% Dicalite 395 |
| " | D. | 60% TA-100, 40% Silica G-28-200, a commercially available silica gel, (Grace Davidson Chemical Co., Baltimore, Maryland) |
| " | E. | 80% TA-100, 20% Silica G-28-200 |
| " | F. | 60% TA-100, 40% Silica AL-1-G-64, silica gel, (Grace Davidson Chemical Co.) |
| " | G. | 80% TA-100, 20% Silica AL-1-G-64 |

-continued

| | | |
|---|---|---|
| " | H. | 50% TA-100, 50% microcrystaline cellulose |
| " | I. | 50% TA-100, 50% cellulose acetate |
| " | J. | 100% TA-100 |
| " | K. | 50% TA-100, 50% $NaHCO_3$ |
| " | L. | 60% TA-100, 40% Urea |
| " | M. | a rinse cycle additive, commercially available as Downy, (Proctor & Gamble Co., Cincinatti, Ohio) containing a tallow methyl quaternary ammonium compound as the active ingredient. |
| " | N. | additive sprayed in dryer, commercially available under the tradename Static Magic, (A. E. Staley Manufacturing Co., Oak Brook, Ill.) containing a fatty substituted methyl quaternary ammonium compound as the active ingredient. |
| " | O. | additive sprayed in dryer, commercially available as Cling Free, (Calgon Corp., Pittsburgh, Pa.) containing a fatty substituted methyl quaternary ammonium compound as the active ingredient. |
| " | P. | a dryer additive on flexible substrate commercially available as Bounce, (Proctor and Gamble Co.), containing a fatty substituted methyl quaternary ammonium compound as the active ingredient. |
| " | Q. | aerosol foam additive sprayed in dryer, commercially available as Petal, (Colgate-Palmolive Co., New York, N.Y.) containing an imidazolinium compound as the active ingredient. |
| " | R. | a wash cycle additive commercially available as Rain Barrel, (S. C. Johnson, Racine, Wisconsin) containing an imidazolinium compound as the active ingredient. |

Formulations A–G and L were compressed to briquets having compressive strengths of 8, 12, and 16 p.s.i. respectively, employing the Komarek Briquetter-Model 100-B described hereinabove set to exert a pressure of 300 psi, a roll speed of 5 rpm, and a feed screw speed of 120-185 fpm.

Formulations H–K were compressed employing a laboratory pellet press which exerted pressures up to 5 tons to make pellets having compressive strengths in excess of 50 psi.

The products were employed to treat fabrics in a GE dryer and evaluated for Break-up Rate, Staining, Absorbancy and Softness using the procedures described above. The results are reported in Tables I – III which follow. In Table I, the total residue found in the dryer is reported. The figure in parentheses represents that portion of the total found in the lint trap. For example, in formulation A-12, after 10 minutes drying time, 3.87 g. of residue were left of which (.43) was found in the lint trap. In Table III, fabrics were treated with products of the invention and compared with formulations indicated in the above list including the leading commercially available washer additives and spray additives to determine and compaare fabrics thus treated for Softness, Rate of Absorbancy after repeated washing and staining.

TABLE I

| Sample Formulation-psi | Wt. Grams, Added to Dryer (GE) | BREAK-UP OF PRODUCTS Weight of Residue After Drying, Grams 1 min. | 5 min. | 10 min. | 15 min. | 20 min. | 58 min. | REMARKS | ABSORBANCY, SEC. |
|---|---|---|---|---|---|---|---|---|---|
| A-8 | 5.55 | 4.03 | 3.27 | 2.77 | 2.47 | 1.80 | 1.00 | Spotting; Large Chunks of Solid Left | — |
| A-12 | 5.72 | 5.28 | 5.38 | 3.87 (.43) | 3.07 (.33) | 2.94 | 1.70 | Spotting; Large Chunks of Solid Left | 63 |
| A-16 | 6.05 | 6.05 | 5.62 | 4.95 | 4.77 | 4.62 | 4.00 | Spotting; Sizable Pieces Left | — |
| B-8 | 6.94 | 2.47 (.55) | 0.90 (.30) | 0.24 (.13) | 0.00 (.05) | 0.00 | 0.00 | No Staining | — |
| B-12 | 7.37 | 3.30 (.05) | 0.95 (.40) | 0.14 (.10) | 0.10 (.08) | 0.00 | 0.00 | No Staining | 38 |
| B-16 | 8.00 | 4.19 (.09) | 1.30 (.80) | 0.60 (.30) | 0.40 (.30) | 0.40 | 0.00 | No Staining | — |
| C-8 | 6.20 | 4.80 (.30) | 3.25 (.25) | 2.60 (.25) | 1.90 (.45) | 1.60 (.65) | 0.40 | Spotting; Residue Soft and Spongy | — |
| C-12 | 6.71 | 6.20 (.20) | 5.25 (.40) | 4.90 (.80) | 4.00 (.60) | 2.90 (1.5) | 1.20 | Spotting; Residue Soft and Spongy | 40 |
| C-16 | 7.60 | 7.40 (.80) | 6.80 (1.7) | 6.40 (.90) | 6.00 (2.7) | 5.50 (1.2) | 1.50 | Spotting; Residue Soft and Spongy | — |
| D-8 | 7.50 | 6.60 (.80) | 4.20 (1.0) | 3.70 (1.0) | 2.20 (1.0) | 1.00 (.60) | 1.00 | Spotting, Residue in Trap | — |
| D-12 | 7.58 | 6.00 (1.5) | 3.00 (1.0) | 2.40 (.80) | 1.50 (.90) | 1.00 (.80) | 0.08 | Spotting at 20 min. with Melted Piece | — |
| D-16 | 7.60 | 6.30 (.09) | 3.30 (.60) | 2.30 (.90) | 1.70 (.30) | 0.90 (.30) | 0.09 | Staining | — |
| E-8 | 6.00 | 4.40 (.10) | 3.50 (.10) | 1.80 (.50) | 1.30 (.20) | 1.30 (.70) | 1.10 | Staining | — |
| E-12 | 6.00 | 5.20 | 3.40 | 2.00 | 1.40 | 0.50 | 0.50 | Staining; Residue | — |

TABLE I-continued

BREAK-UP OF PRODUCTS

| Sample Formulation-psi | Wt. Grams, Added to Dryer (GE) | Weight of Residue After Drying, Grams 1 min. | 5 min. | 10 min. | 15 min. | 20 min. | 58 min. | REMARKS | ABSORBANCY, SEC. |
|---|---|---|---|---|---|---|---|---|---|
| E-16 | 6.00 | (.10) 5.60 | (.30) 4.70 | (.20) 4.60 | (.50) 4.10 | (.10) 3.80 | 1.00 | stuck to Clothes Staining | — |
| F-8 | 7.56 | (.10) 2.19 | (.30) 0.94 | (.30) 0.27 | (1.5) 0.18 | (.50) 0.14 | 0.06 | Staining | — |
| F-12 | 8.50 | (.56) 3.43 | (.60) 0.90 | (.13) 0.32 | (.18) 0.12 | (.12) 0.12 | 0.00 | Staining | 63 |
| F-16 | 8.62 | (.57) 2.60 | (.61) 0.54 | (.26) 0.21 | (.10) 0.12 | (.05) 0.10 | 0.00 | Staining | — |
| G-8 | 6.00 | (.84) 3.60 | (.42) 0.90 | (.10) 0.50 | (.08) 0.10 | (.06) 0.05 | 0.00 | Staining | — |
| G-12 | 6.30 | (.05) 4.40 | (.10) 2.00 | (.10) 1.19 | (.10) 0.84 | (.03) 0.60 | 0.25 | Staining | 39 |
| G-16 | 6.61 | (.08) 6.06 | (.40) 3.73 | (.52) 2.52 | (.52) 1.74 | (.41) 0.96 | 0.11 | Staining | — |
| H | 2.00 | (2.4) No Break-Up | (2.54) — | (.81) — | (1.07) — | (.61) — | No Break-Up | — | — |
| I | 2.00 | No Break-Up | — | — | — | — | No Break-Up | — | — |
| J | 2.00 | No Break-Up | — | — | — | — | No Break-Up | — | — |
| K | 2.00 | No Break-Up | — | — | — | — | No Break-Up | — | — |
| L-12 | — | — | — | — | — | — | — | — | 41 |
| M-Rinse Cycle Additive | — | — | — | — | — | — | — | — | 200 |
| N-Additive Sprayed in Dryer | — | — | — | — | — | — | — | — | 70 |
| 0-Wash Cycle Additive | — | — | — | — | — | — | — | — | 600 |
| P-Dryer Additive Flexible Substrate | — | — | — | — | — | — | — | — | 28 |
| Q-Additive Sprayed in Dryer | — | — | — | — | — | — | — | — | 40 |
| Control - Untreated Sample | — | — | — | — | — | — | — | — | 22.75 |

TABLE II

STAIN RATING OF FORMULATIONS

| Sample, Formulations-psi | Fabric Treated | Size of Spots, Inches | No. of Spots | Square Inch Area | Total Fabric Area, Sq. inch | Spotting/ Staining % of Total Area |
|---|---|---|---|---|---|---|
| A-12 | Permanent Press | ⅛–¼ | 45 | 1.39 | 1344 | 1.1 |
| | | ¼–½ | 23 | 2.87 | | |
| | | ½–1 | 9 | 4.50 | | |
| | | Larger | 6 | 6.00 | | |
| B-12 | Permanent Press | NO SPOTTING OR STAINING | | | | 0.0 |
| C-12 | Permanent Press | ⅛–¼ | 55 | 1.70 | 1714 | 1.1 |
| | | ¼–½ | 38 | 4.75 | | |
| | | ½–1 | 15 | 7.50 | | |
| | | Larger | 5 | 5.00 | | |
| D-12 | Permanent Press | ⅛–¼ | 13 | 0.40 | 1834 | 0.1 |
| | | ¼–½ | 13 | 1.62 | | |
| | | ½–1 | 0 | | | |
| | | Larger | 0 | | | |
| E-12 | Permanent Press | ⅛–¼ | 90 | 2.79 | 1852 | 1.11 |
| | | ¼–½ | 55 | 6.87 | | |
| | | ½–1 | 18 | 9.00 | | |
| | | Larger | 2 | 2.00 | | |
| F-12 | Permanent Press | ⅛–¼ | 110 | 3.41 | 1588 | 0.22 |
| | | ¼–½ | 1 | 0.12 | | |
| | | –1 | 0 | | | |
| | | Larger | 0 | | | |
| G-12 | Permanent Press | ⅛–¼ | 160 | 4.96 | 2016 | 0:64 |
| | | ¼–½ | 16 | 2.00 | | |
| | | ½–1 | 4 | 2.00 | | |
| | | Larger | 4 | 4.00 | | |

TABLE III

SOFTNESS

| Formulation | Form of Product | Dryer Type; Clothes Type; Temperature F Time | Towel No. | Product Used | Ranking Sample No. | Ranking Sample Product Used | Points |
|---|---|---|---|---|---|---|---|
| 1) 5.3g Adogen 442; 50 ml. Water; .75g Cabosil; 1g. Wood Pulp | Disc; Hand Pressed in 1½ inch mold | GE; Mixed 140–180°F 53 min. | 1 | Control | 2 | M | 9 |
| | | | 2 | M | 3 | R | 6 |
| | | | 3 | R | 4 | Form. 1 | 3 |
| | | | 4 | Form. 1 | 1 | Control | 0 |
| 2) 5.9g TA-100 | Briquet; 0 pressure | " | 1 | Control | 2 | M | 11 |
| | | | 2 | M | 4 | Form. 2 | 8 |
| | | | 3 | R | 3 | R | 3 |
| | | | 4 | Form. 2 | 1 | Control | 2 |
| 3) 5.7g TA-100 | Briquet; 150 psi | " | 1 | Control | 2 | M | 7 |
| | | | 2 | M | 4 | Form. 3 | 6 |
| | | | 3 | R | 3 | R | 3 |
| | | | 4 | Form. 3 | 1 | Control | 2 |
| 4) 3g. TA-100 .5g. Tri-sodium phosphate | Disc as in 1; 50 psi | " | 1 | O | 2 | M | 8 |
| | | | 2 | M | 4 | Form. 4 | 6 |
| | | | 3 | R | 1 | 0 | 3 |
| | | | 4 | Form. 4 | 3 | R | 1 |
| 5) 6g. 95% TA-100; 5% $H_2O$ | Briquet; 150 psi | " | 1 | 0 | 2 | M | 15 |
| | | | 2 | M | 4 | Form. 5 | 11 |
| | | | 3 | R | 3 | R | 8 |
| | | | 4 | Form. 5 | 1 | O | 2 |
| 6) A)4.05g. 25% Dica-395, 75% TA-100; B)38% Dry Ice 70% TA-100; 3.4g C)70% Arquad 2HT-75; 25% Dicalite 395 4.05g | Briquets | GE; Perman-ent Press; 120°–190°F; 50 min. | 1 | 6C | 4 | 6B | 11 |
| | | | 2 | M | 1 | 6C | 10 |
| | | | 3 | 6A | 3 | 6A | 9 |
| | | | 4 | 6B | 2 | M | 6 |
| 7) 6.98g 60% TA-100; 40% Dicalite 395 (18.7 psi) | " | Whirlpool; Permanent Press 120–190°F; 50 min. | 1 | R | 4 | Form. 7 | 14 |
| | | | 2 | M | 2 | M | 10 |
| | | | 3 | P | 1 | R | 6 |
| | | | 4 | Form. 7 | 3 | P | 6 |
| 8) 60% TA-100; 40% Dicalite A)18.7 psi-7.5g B)14.3 psi-7.5g C)14.9 psi-7.2g D)18.7 psi-6.9g | " | GE; Mixed; 140–180°F; 60 min. | 1 | 8D | 2 | 8A | 12 |
| | | | 2 | 8A | 1 | 8D | 11 |
| | | | 3 | 8B | 3 | 8B | 8 |
| | | | 4 | 8C | 4 | 8C | 5 |
| 9) A)70% TA-100; 30% Dicalite (8 psi) B)50% TA-100; 50% Dicalite (8 psi) C)60% TA-100; 40% Dicalite (8 psi) | " | GE; Permanent Press; 110°F–180°F 50 min. | 1 | 9A | 1 | 9A | 14 |
| | | | 2 | 9C | 2 | 9C | 9 |
| | | | 3 | 9B | 3 | 9B | 8 |
| | | | 4 | M | 4 | M | 5 |
| 10) A)9A-12 psi B)9B- " C)9C- " | " | " | 1 | 10A | 3 | 10B | 14 |
| | | | 2 | 10C | 1 | 10A | 10 |
| | | | 3 | 10B | 2 | 10C | 7 |
| | | | 4 | M | 4 | M | 5 |
| 11) A)9A-16 psi B)9B- " C)9C- " | " | " | 1 | 11A | 2 | 11C | 11 |
| | | | 2 | 11C | 4 | M | 10 |
| | | | 3 | 11B | 3 | 11B | 8 |
| | | | 4 | M | 1 | 11A | 7 |
| 12) A)9A-20 psi B)9B " C)9C " | " | " | 1 | 12A | 1 | 12A | 13 |
| | | | 2 | 12C | 2 | 12C | 12 |
| | | | 3 | 12B | 3 | 12B | 8 |
| | | | 4 | M | 4 | M | 3 |
| 13) A)9C-12 psi B)9B- " C)60% TA-100 40% Urea | " | " | 1 | 13A | 1 | 13A | 13 |
| | | | 2 | 13B | 2 | 13B | 12 |
| | | | 3 | 13C | 3 | 13C | 8 |
| | | | 4 | M | 4 | M | 3 |
| 14) A)50% TA-100 50% Dicalite; 16 psi | " | GE; Mixed 50 min. 110°F–180°F | 1 | 14A | 2 | 14B | 17 |
| | | | 2 | 14B | 1 | 14A | 12 |
| | | | 3 | M | 3 | M | 5 |
| | | | 4 | M | 4 | M | 2 |
| B)50% TA-100 50% Dicalite 16 psi | " | GE; Mixed 50 min. Air-Fluff Setting; No Heat | | | | | |
| 15) A)14A B)14B | " | Whirlpool; Permanent Press; 50 min. 110°–180°F in A; Air-Fluff No Heat in B. | 1 | 15B | 3 | M | 15 |
| | | | 2 | 15A | 2 | 15A | 9 |
| | | | 3 | M | 4 | M | 7 |
| | | | 4 | M | 1 | 15B | 5 |

It will be seen from Tables I to III that products produced according to this invention are unique in several respects. Referring to Table I, products prepared with the formulations of the invention disintegrated within a period of 5 to 20 minutes with no staining of the fabrics. Products produced by formulations and/or methods similar to those of the invention but in which other substances were substituted for diatomaceous earth either did not break up at all or broke up at an inadequate rate resulting in staining. From Tables II and III it will be apparent that the instant products are highly effective as fabric softeners resulting in no staining of the fabrics. The absorbancy data is particularly valuable in evaluating the effectiveness of the products of the invention. It is obvious from this data that the instant products affect the rate of absorbancy less than commercially available washer, rinse or dryer spray products. The change in absorbancy rate of towels softened by the products of this invention is much less than that change exhibited with towels softened with other products. It is believed that the reason lies in the fact that the softener briquet of the invention puts softener only on the nap or surface of the fabric with little disposition in the woven structure. Indeed, dyeing the towels with a dye which colors only the softener confirms this hypothesis. This is a valuable property since repeated applications of the product will not decrease the absorbancy as much as other products which treat the weave of the fabric as well as the nap and often lead to water repellency.

Additionally, a major difference between the products of the invention and prior compositions is the apparent high quality softness obtained yet the adjuvant added for this purpose appears to be distributed nonuniformly. Prior workers in the art have emphasized that distributing agents were necessary in fabric softener application to fabrics to effect the behavior of the softener once it contacted the fabric to prevent staining by moving the softener or other conditioners evenly through the cloth. In the products of this invention, it is believed that a different mechanism is involved. The diatomaceous earth in association with the conditioning agent appears to make the briquet breakup more rapidly than it would otherwise but not so rapidly as to result in loss of softening effect. Further it is believed that the diatomaceous earth lowers the physical strength of the solid softener to the point that no large quantity can adhere to any piece of fabric thereby eliminating staining. It appears that if a large quantity of softener becomes stuck to an item in the dryer, the forces exerted on the piece by the dryer tumbling are sufficient to cause the piece to break off near the fabric-softener interface thereby reducing local concentration below the staining level. Additionally, swatches of fabric treated with commerical rinse and wash cycle additives when tested for distribution as described hereinabove show a light blue color which is continuous and uniform with no local variation in color density to the eye. Swatches treated with the products of the invention show throughout the fabric a nonuniform fiber coloration on the surface separated by an internal fiber matrix with substantially no color. This near microscopic discontinuity is not detectable by hand nor is it accompanied by a decreased difference in softness. Rather, it is believed to be a major factor in obtaining such softness by positioning the softener on the surface where it can be felt while leaving the internal fiber structure uncoaated so it is capable of exerting its full capacity of absorption.

It should also be noted in Table III (Formulations 14 and 15) that products of the invention are highly effective even in the absence of heat.

EXAMPLE 2

To illustrate further the products of this invention briquets were prepared, employing the Briquetter of Example 1, from varying proportions of softening agent and diatomaceous earth and compacted to exhibit compressive strengths as indicated hereinbelow.

Two runs, each of which contained an 8 lb. load of damp mixed fabrics, were conducted by placing together with the load a briquet of the invention in a G. E. dryer and tumbling for 50 minutes at normal dryer temperatures, after which the residue left in the lint trap was weighed to determine the extent of disintegration of the product. For comparison, a simialr product but in which urea was substituted for diatomaceous earth was prepared and utilized. The results were as indicated in Table IV reported as average values from the two runs. For comparison, the same runs were made employing a briquet of the invention in the same manner as described above but without heat. The results are also described in Table IV.

TABLE IV

Disintegration As Related To Proportion Of Diatomaceous Earth and Compressive Strength

| Briquet Formulation | Compressive Strength, psi | Weight Added, grams | Weight of Residue After 50 minutes | % Product Disintegrated, Applied To Fabrics and/or Vented |
|---|---|---|---|---|
| 65% TA-100 | 8 | 6.7 | 0.87 | 88 |
| 35% Dicalite 395 | 12 | 6.9 | 1.30 | 81 |
| | 16 | 7.2 | 1.70 | 77 |
| | 20 | 7.5 | 1.80 | 77 |
| 70% TA-100 | 8 | 6.4 | 0.56 | 92 |
| 30% Dicalite 395 | 12 | 6.8 | 1.30 | 81 |
| | 16 | 7.0 | 1.80 | 75 |
| | 20 | 7.3 | 1.90 | 74 |
| 60% TA-100 | 8 | 6.8 | 0.46 | 94 |
| 40% Dicalite 395 | 12 | 7.2 | 0.39 | 95 |
| | 16 | 7.8 | 1.40 | 83 |
| | 20 | 8.2 | 1.90 | 77 |
| 55% TA-100 | 8 | 6.9 | 0.22 | 97 |
| 45% Dicalite 395 | 12 | 7.4 | 0.60 | 92 |
| | 16 | 7.7 | 1.20 | 85 |
| | 20 | 8.4 | 1.20 | 86 |
| 50% TA-100 | 8 | 6.9 | 0.37 | 95 |
| 50% Dicalite 395 | 12 | 7.4 | 0.46 | 94 |
| | 16 | 8.2 | 0.62 | 93 |
| | 20 | 8.8 | 1.40 | 87 |
| 60% TA-100 | 8 | — | — | — |
| 40% Urea | 12 | 7.3 | 5.0 | 31 |
| | 16 | — | — | — |
| | 20 | — | — | — |
| *50% TA-100 | 16 | 7.0 | .02 | 99 |

TABLE IV-continued

Disintegration As Related To Proportion Of Diatomaceous Earth and Compressive Strength

| Briquet Formulation | Compressive Strength, psi | Weight Added, grams | Weight of Residue After 50 minutes | % Product Disintegrated, Applied To Fabrics and/or Vented |
|---|---|---|---|---|
| 50% Dicalite 395 | 16 | 6.8 | .09 | 98 |
| | 16 | 6.75 | .31 | 95 |

*Run for 50 minutes;GE-dryer on Air-Fluffsetting; No Heat

It will be seen from the above Table that the products of the invention containing various proportions of the components of the composition and compressed to various compressive strengths are consistently and effectively disintegrated and applied in major proportion as a result of said disintegration, particularly when compared to products containing a distributing agent of the prior art and even when used in the absence of high temperatures.

Although the above examples have illustrated compositions consisting essentially of softener additives and diatomaceous earth, it will be apparent that other conditioners may be substituted for and/or combined with the softener additives for treatment other than softening of the fabric. For example, products of the invention may be formulated with germicides, colorants, optical brighteners, fire retardant agents, soil repellants, hand modifiers, moth-proofing agents, water-repellants, fluorescents, etc. or a single additive or mixture of quaternary ammonium compounds, for example, may perform several of these functions. For example, quaternary ammonium softener additives are known to possess antistatic and some germicidal properties.

A typical composition performing several of these functions is a briquet containing:

| | |
|---|---|
| 3 | parts Arosurf TA-100 (softener) |
| 3 | parts Dicalite 395 |
| 1 | part Ceranine H-CA granules (stearic hydroxyethylene diamine; softener, antistat, mild bactericide) |
| 0.5 | part Sandoz TH-40 (triazinostilbene; whitener, for cottons) |
| 0.02 | part Aclarat 8678 (4-methyl-7-diethyl coumarin; whitener for synthetics and wool) |
| 0.005 | to 0.015 parts of colorants, for example Brilliant Alizarine Milling Blue-BL-050 or Sandocryl Brilliant Yellow B-10G or Brilliant Alizarine Milling Violet FBL, etc. |
| | Perfume, as desired. |

Sanitizing compositions may include benzalkonium chlorides, cetyl trimethyl ammonium chloride; cetyl pyridinium chloride; diisobutyl cresoxyethoxyethyl dimethyl benzyl ammonium chloride; N-[acylcolaminoformylmethyl] pyridinium chloride; cetyl trimethyl ammonium p-toluene sulfonate; diisobutylphenoxyethoxyethyl dimethylbenzyl ammonium chloride monohydrate, etc.

It is thought that the invention and many of its attendant advantages will be understood from the foregoing description and it will be apparent that various changes may be made in the matter of the ingredients and their proportions and in the steps of the method and their order of accomplishment without departing from the spirit and scope of the invention or sacrificing all of its material advantages, the form hereinbefore described being merely a preferred embodiment thereof.

We claim:

1. A fabric conditioner composition consisting essentially of a conditioning agent in admixture with diatomaceous earth, said mixture being in solid, compressed form, containing from about 70 to about 45% conditioner and from about 30 to about 55% diatomaceous earth, and exhibiting a compressive strength of from about 8 to about 26 pounds per square inch.

2. A composition of claim 1 wherein said conditioner is a cationic quaternary ammonium salt.

3. A composition of claim 2 wherein said composition contains about 60% by weight of a fabric softener and 40% by weight diatomaceous earth.

4. A fabric softener composition consisting essentially of about 45 to 70% by weight of a tallow alkyl ammonium chloride and about 30 to about 55% by weight of diatomaceous earth in solid, compressed form, exhibiting a compressive strength of from about 8 to about 26 pounds per square inch.

5. A composition of claim 4 wherein said composition contains about 60% by weight tallow alkyl ammonium chloride and about 40% by weight diatomaceous earth.

6. A composition of claim 1 in briquet form.

7. A composition of claim 4 in briquet form.

8. A process for the production of a solid fabric conditioner suitable for use in a clothes dryer which comprises admixing a fabric conditioner adjuvant with diatomaceous earth with sufficient pressure at a sufficient rate to obtain a solid, compacted product exhibiting compressive strength of from about 8 to about 26 pounds per square inch.

* * * * *